US009982645B2

(12) United States Patent
Hirose et al.

(10) Patent No.: US 9,982,645 B2
(45) Date of Patent: May 29, 2018

(54) REMOTE ENGINE STARTING SYSTEM

(71) Applicant: HONDA MOTOR CO., LTD., Tokyo (JP)

(72) Inventors: Motohisa Hirose, Wako (JP); Katsuyasu Yamane, Wako (JP); Takashi Mori, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days. days.

(21) Appl. No.: 14/977,109

(22) Filed: Dec. 21, 2015

(65) Prior Publication Data

US 2016/0177908 A1 Jun. 23, 2016

(30) Foreign Application Priority Data

Dec. 22, 2014 (JP) ..... 2014-259210

(51) Int. Cl.
*F02N 11/08* (2006.01)

(52) U.S. Cl.
CPC ..... *F02N 11/0807* (2013.01); *F02N 11/087* (2013.01)

(58) Field of Classification Search
CPC ..... F02N 11/0807; F02N 11/087; B60H 1/00878
See application file for complete search history.

(56) References Cited

U.S. PATENT DOCUMENTS 9,062,617 B2 * 6/2015 Mauti, Jr. ..... F02D 29/02
2008/0147270 A1 * 6/2008 Sakane ..... B60H 1/00792 701/36

(Continued)

FOREIGN PATENT DOCUMENTS

| | | | |
|---|---|---|---|
| CN | 103174336 | A | 6/2013 |
| CN | 103386937 | A | 11/2013 |
| JP | 2011-168162 | A | 9/2011 |
| JP | 2012-071695 | A | 4/2012 |
| JP | 2013-130013 | A | 7/2013 |

OTHER PUBLICATIONS

Notification of Reasons for Refusal dated Aug. 9, 2016, issued in counterpart Japanese Patent Application No. 2014-259210, with English translation. (6 pages).

(Continued)

*Primary Examiner* — Joseph Dallo
*Assistant Examiner* — Kurt Liethen
(74) *Attorney, Agent, or Firm* — Westerman, Hattori, Daniels & Adrian, LLP

(57) ABSTRACT

A remote engine starting system includes a portable terminal that is carried by a user and a vehicle that allows an engine to be started in response to receiving an engine start signal transmitted from the portable terminal. The vehicle periodically transmits a query signal for establishment of a wireless communication link with the portable terminal to a predetermined range surrounding the vehicle to define a predetermined wireless communication area of the vehicle. A control unit of the portable terminal determines, based on whether the wireless communication link with the vehicle is established, whether the portable terminal is within the wireless communication area. The control unit transmits an engine start signal when the portable terminal enters the wireless communication area surrounding the vehicle while automatic start setting is enabled by the user.

7 Claims, 3 Drawing Sheets

(56) References Cited

U.S. PATENT DOCUMENTS

| | | | | |
|---|---|---|---|---|
| 2009/0251284 | A1* | 10/2009 | Wilson | F02N 11/0807 340/5.64 |
| 2009/0261945 | A1* | 10/2009 | Ko | B60R 25/245 340/5.61 |
| 2011/0074561 | A1* | 3/2011 | Mackjust | B60R 25/10 340/426.13 |
| 2011/0202201 | A1 | 8/2011 | Matsubara | |
| 2012/0323407 | A1* | 12/2012 | Koike | B60R 25/04 701/2 |
| 2015/0363988 | A1* | 12/2015 | Van Wiemeersch | H04M 1/11 455/557 |
| 2016/0096412 | A1* | 4/2016 | Mankame | B60H 1/00792 165/11.2 |

OTHER PUBLICATIONS

Chinese Office Action dated Apr. 6, 2017, issued in Chinese Patent Application No. 201510870228.0, with English language translation (13 pages).

* cited by examiner

REMOTE ENGINE STARTING SYSTEM

CROSS REFERENCES TO RELATED APPLICATIONS

The present application claims priority under 35 U.S.C. § 119 to Japanese Patent Application No. 2014-259210, filed Dec. 22, 2014, entitled "Remote Engine Starting System." The contents of this application are incorporated herein by reference in their entirety.

BACKGROUND

1. Field

The present disclosure relates to a remote engine starting system.

2. Description of the Related Art

Vehicle control systems known in the art are configured to allow a remote operation terminal to transmit a start signal to a vehicle in response to a user's operation on an engine start button of the remote operation terminal, determine that the vehicle can be warmed up as long as the vehicle receiving the start signal satisfies predetermined conditions, and start an engine (refer to, for example, Japanese Unexamined Patent Application Publication No. 2012-71695).

In such a related-art vehicle control system, a user who intends to remotely start the engine has to operate the engine start button of the remote operation terminal within a range where a start signal from the remote operation terminal can reach the vehicle. If radio waves generated by the first operation on the engine start button fail to reach the vehicle, the user has to again operate the engine start button while approaching the vehicle. The operation for starting the engine may be complicated.

SUMMARY

The present application has been made in consideration of the above-mentioned circumstances. The present application describes a remote engine starting system that enables an engine to be remotely started without reducing user convenience.

An aspect of the present disclosure provides a remote engine starting system including a portable terminal (e.g., a portable terminal 11 in an embodiment) that is carried by a user, and a vehicle (e.g., a vehicle 12 in the embodiment) that allows an engine (e.g., an engine 44 in the embodiment) to be started in response to receiving an engine start signal transmitted from the portable terminal. The vehicle defines a communication area having a predetermined range surrounding the vehicle. The portable terminal includes a determining unit (a determiner for a portable terminal location, e.g., a control unit 24 that may function as the determiner in the embodiment) that determines whether the portable terminal is within the communication area, a control unit (i.e., a controller of the portable terminal, e.g., the control unit 24 in the embodiment) that communicates with the vehicle when the determining unit determines that the portable terminal is within the communication area, and a setting unit (a setting controller, e.g., the control unit 24 that may function as the setting controller in the embodiment) that allows the user of the vehicle to switch its setting between two different settings, i.e., (i) a first setting that enables the transmitting of the engine start signal or (ii) a second setting that disables the transmitting of the engine start signal while the portable terminal is within the communication area. The control unit transmits the engine start signal when the determining unit determines that the portable terminal is within the communication area while the setting is enabled by the setting unit.

In the system according to this aspect, the engine start signal is automatically transmitted as long as the user intends to remotely start the engine (namely, the setting for transmitting the engine start signal is enabled). This can improve user convenience. Although the user is not being aware whether the portable terminal is within the communication area of the vehicle, the engine is automatically remotely started while the portable terminal is within the communication area. This can prevent a user operation necessary to start the engine from being complicated.

In this aspect, the vehicle may define the communication area by periodically transmitting a query signal to the predetermined range while a communication link with the portable terminal is not established. The portable terminal may perform link establishment including authentication in response to receiving the query signal to allow transmission of the engine start signal.

In this case, since the engine start signal from the authentic portable terminal performing link establishment including authentication is validated, security can be improved.

In this aspect, the determining unit may determine based on an established state of a communication link with the vehicle that the portable terminal is within the communication area.

In this case, it can be accurately determined that the portable terminal is within the communication area without using any additional special component for determining the position of the portable terminal.

In this aspect, the setting unit may switch the setting from an enabled state to a disabled state when the engine is started in response to the engine start signal transmitted from the portable terminal.

In this case, if the user forgot that he or she enabled automatic start setting at the last remote start and enters the communication area of the vehicle, the engine can be prevented from being started regardless of user's intention.

In this aspect, the predetermined range may be set to a line-of-sight distance from the vehicle. The vehicle may have a lighting device (e.g., a light 47 in the embodiment) on an exterior of the vehicle and allow it to be turned on or blinked in response to receiving the engine start signal.

In this case, it is unnecessary for the portable terminal to have a function for answer-back control, so that functions of the portable terminal can be simplified. This can reduce power consumption of the portable terminal.

In this aspect, the vehicle may allow an air-conditioner (e.g., an air-conditioner 45 in the embodiment) to be actuated to achieve a predetermined target temperature in addition to allowing the engine to be started in response to receiving the engine start signal. When an interior temperature of the vehicle is higher than the target temperature by a predetermined value or more, the vehicle may allow an openable and closable structure (e.g., an openable and closable structure in the embodiment) of the vehicle to be opened by a predetermined amount.

In this case, the air in the vehicle interior can be partially discharged to the outside by opening the openable and closable structure as well as actuating the air-conditioner, thus enabling the interior temperature to approach the target temperature in a shorter time.

In this aspect, the portable terminal may include a display screen (e.g., a display screen 22*a* in the embodiment). The setting unit may enable or disable the setting in accordance with an operation on the display screen. Display on the display screen and the setting may be executed in accordance with a program stored in the portable terminal.

In this case, an automatic engine starting function can be easily added to the portable terminal of a general purpose type.

DESCRIPTION OF THE PREFERRED EMBODIMENTS

A remote engine starting system according to an embodiment of the present disclosure will be described with reference to the accompanying drawings.

Figure 1:
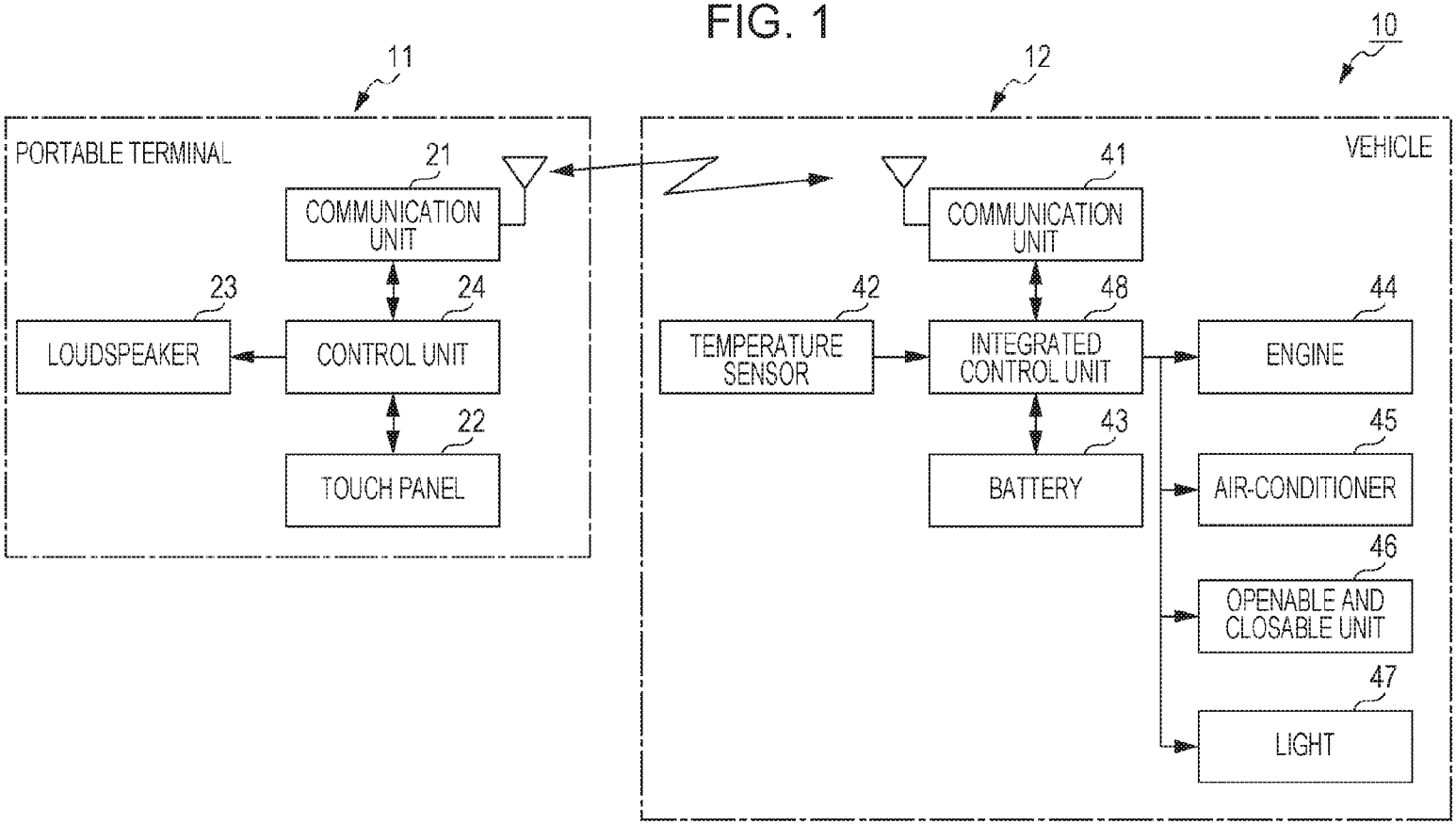
FIG. 1 is a block diagram of a remote engine starting system according to an embodiment of the present disclosure.

The remote engine starting system, indicated at 10, according to the present embodiment includes a portable terminal 11 and a vehicle 12 as illustrated in FIG. 1.

The portable terminal 11 is a remote operating device that is carried by a driver of the vehicle 12. The portable terminal 11 communicates with the vehicle 12 by radio over, for example, a short-range wireless communication link, such as Bluetooth (registered trademark), or a wireless local area network (LAN), such as Wi-Fi (registered trademark).

The portable terminal 11 includes a communication unit 21, a touch panel 22, a loudspeaker 23, and a control unit 24.

The communication unit 21 communicates with a communication unit 41, which will be described later, of the vehicle 12 in a wireless manner in accordance with a signal from the control unit 24.

The touch panel 22 displays a predetermined screen associated with execution of various programs (for example, application programs) stored in the control unit 24. The touch panel 22 can display, for example, a state of the vehicle 12, and an operation screen and a setting screen for remotely operating a function of the vehicle 12. The touch panel 22 outputs an instruction signal specifying an operation of the vehicle 12 in response to a touch of a user's finger on the operation screen or the setting screen.

The loudspeaker 23 outputs any of various sounds or a signal sound played in accordance with data stored in the control unit 24. The loudspeaker 23 generates, for example, a warning sound that can be perceived by the driver carrying the portable terminal 11.

Figure 2:
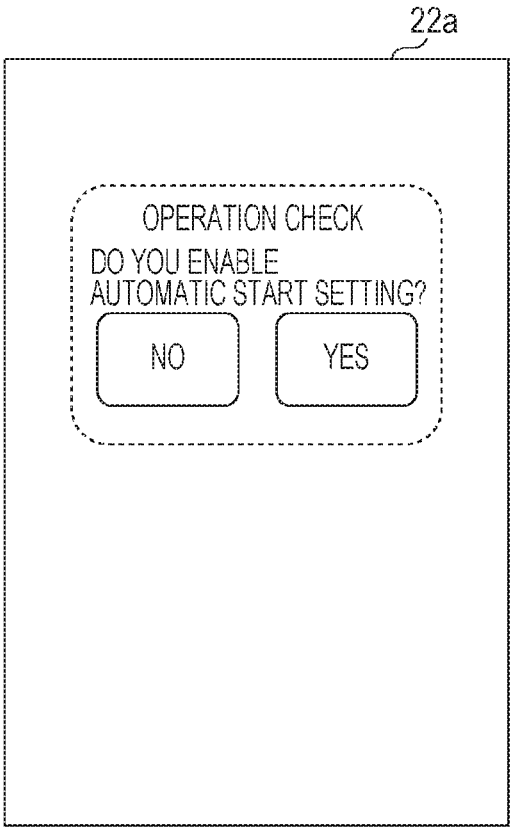
FIG. 2 illustrates an example of a setting screen displayed on a display screen of a portable terminal of the remote engine starting system according to the embodiment.

The control unit 24 performs centralized control of operation of the portable terminal 11. The control unit 24 includes a processor, such as a central processing unit (CPU), a read-only memory (ROM) for storing programs, and a random access memory (RAM) for temporarily storing data. The various programs are stored in the control unit 24. The application programs (hereinafter, referred to as "predetermined programs") for displaying, for example, a state of the vehicle 12 and operation and setting screens for remotely operating functions of the vehicle 12 on a display screen are stored in the control unit 24. The predetermined programs include a predetermined program for displaying an operation screen for operating the vehicle 12, for example, locking or unlocking a door of the vehicle 12, starting an engine 44 of the vehicle 12, or actuating an in-vehicle device, such as an air-conditioner 45, in the vehicle 12, on the display screen. The predetermined programs include a predetermined program for displaying a setting screen for enabling or disabling automatic start setting on the display screen. The term "automatic start setting" as used herein refers to an operation for, when the portable terminal 11 is within a predetermined wireless communication area surrounding the vehicle 12, automatically transmitting an operation signal (engine start signal) for starting the engine 44 of the vehicle 12 to start the engine 44. Referring to FIG. 2, a setting screen displayed on a display screen 22*a* of the touch panel 22 prompts the user to select enabling or disabling of the automatic start setting such that the user can change the selection.

When the control unit 24 starts to execute a predetermined program requiring establishment of a wireless communication link with the vehicle 12 before the establishment of the wireless communication link with the vehicle 12, the control unit 24 performs a scanning operation during which a query signal transmitted from the vehicle 12 can be received at predetermined regular intervals. When the control unit 24 receives a query signal upon movement of the portable terminal 11 into the predetermined wireless communication area surrounding the vehicle 12, the control unit 24 performs processing of link establishment including authentication, and transmits a response to the query signal to communicate with the vehicle 12. If enabling or disabling of the automatic start setting is selected in advance by the user, the control unit 24 enables or disables the automatic start setting in accordance with the selection. If enabling or disabling of the automatic start setting is not selected in advance by the user, the setting screen may be displayed.

After the establishment of the wireless communication link with the vehicle 12, the control unit 24 communicates with the vehicle 12 at predetermined regular intervals. Consequently, the control unit 24 can receive a signal containing information about a state of the vehicle 12 and transmit an operation signal for remotely operating a function of the vehicle 12.

When the communication unit 21 receives any of various signals, such as a signal containing information about a state of the vehicle 12, transmitted from the vehicle 12, the control unit 24 controls display on the display screen 22*a* of the touch panel 22 and an operation of the loudspeaker 23 in accordance with the signal. When an operation signal for operating a function of the vehicle 12 is output from the touch panel 22 in response to a user's touch on an operation screen displayed on the touch panel 22, the control unit 24 allows the communication unit 21 to transmit the operation signal to the vehicle 12. When the portable terminal 11 enters the predetermined wireless communication area surrounding the vehicle 12 while the automatic start setting is enabled, the control unit 24 automatically transmits an operation signal (engine start signal) for starting the engine 44 of the vehicle 12 to the vehicle 12. The control unit 24 determines based on an established state of the wireless communication link with the vehicle 12 that the portable terminal 11 is within the predetermined wireless communication area.

The vehicle 12 includes the communication unit 41, a temperature sensor 42, a battery 43, the engine 44, the air-conditioner 45, an openable and closable unit 46, a light 47, and an integrated control unit 48. The communication unit 41, the temperature sensor 42, the battery 43, the engine 44, the air-conditioner 45, the openable and closable unit 46, the light 47, and various in-vehicle devices are connected to the integrated control unit 48 via, for example, a controller area network (CAN) communication network that is a general purpose in-vehicle communication network.

The communication unit 41 communicates with the communication unit 21 of the portable terminal 11 by radio in accordance with a signal from the integrated control unit 48.

The temperature sensor 42 outputs a signal indicative of the temperature of a vehicle interior of the vehicle 12.

The battery 43 supplies power to the vehicle 12.

The engine 44 is a driving source including an internal combustion engine and a motor.

The air-conditioner 45 adjusts the temperature and humidity of the vehicle interior of the vehicle 12 to target values.

The openable and closable unit 46 includes an openable and closable structure, which is disposed in the vehicle 12 and is electrically opened or closed, and an actuator driving the openable and closable structure. Examples of the openable and closable structure include a power window, a sunroof, and a power sliding door.

Examples of the light 47 include a headlight, a tail light, and indicators arranged on an exterior of the vehicle 12.

The integrated control unit 48 controls the vehicle 12 in a centralized manner. The integrated control unit 48 includes a processor, such as a CPU, a ROM for storing programs, and a RAM for temporarily storing data.

The integrated control unit 48 continuously monitors a state of the vehicle 12 in accordance with signals output from various vehicle state sensors.

Before establishment of a wireless communication link with the portable terminal 11, the integrated control unit 48 periodically transmits a query signal for link establishment to a predetermined range surrounding the vehicle 12, thus defining the predetermined communication area surrounding the vehicle 12. The predetermined range is, for example, a range having a boundary at a line-of-sight distance (i.e., a distance in which the user carrying the portable terminal 11 can see the vehicle 12) from the vehicle 12.

The integrated control unit 48 performs processing, such as authentication, to establish a wireless communication link with the portable terminal 11 upon receiving a response to the query signal, transmitted periodically to the area surrounding the vehicle 12, from the portable terminal 11. After the establishment of the wireless communication link with the portable terminal 11, the integrated control unit 48 and the portable terminal 11 communicate with each other at predetermined regular intervals. The integrated control unit 48 periodically transmits a signal containing information about a state of the vehicle 12 through communication with the portable terminal 11. Examples of information about a state of the vehicle 12 include information indicating whether the engine 44 is in an ON state, information indicating whether the air-conditioner 45 is in an ON state, information indicating a state of the openable and closable unit 46, and information indicating a state of the light 47.

After the establishment of the wireless communication link with the portable terminal 11, the integrated control unit 48 starts the engine 44 and also turns on or blinks the light 47 in response to receiving an engine start signal from the portable terminal 11. The integrated control unit 48 actuates the air-conditioner 45 in addition to starting the engine 44 so that the temperature of the vehicle interior reaches a predetermined target temperature. The predetermined target temperature may be previously stored in the integrated control unit 48 or may be contained in a signal to be transmitted from the portable terminal 11 in accordance with a user instruction. When the interior temperature of the vehicle 12 is higher than the predetermined target temperature by a predetermined value or more, the integrated control unit 48 drives the openable and closable unit 46 to open the openable and closable structure by a predetermined amount.

Figure 3:
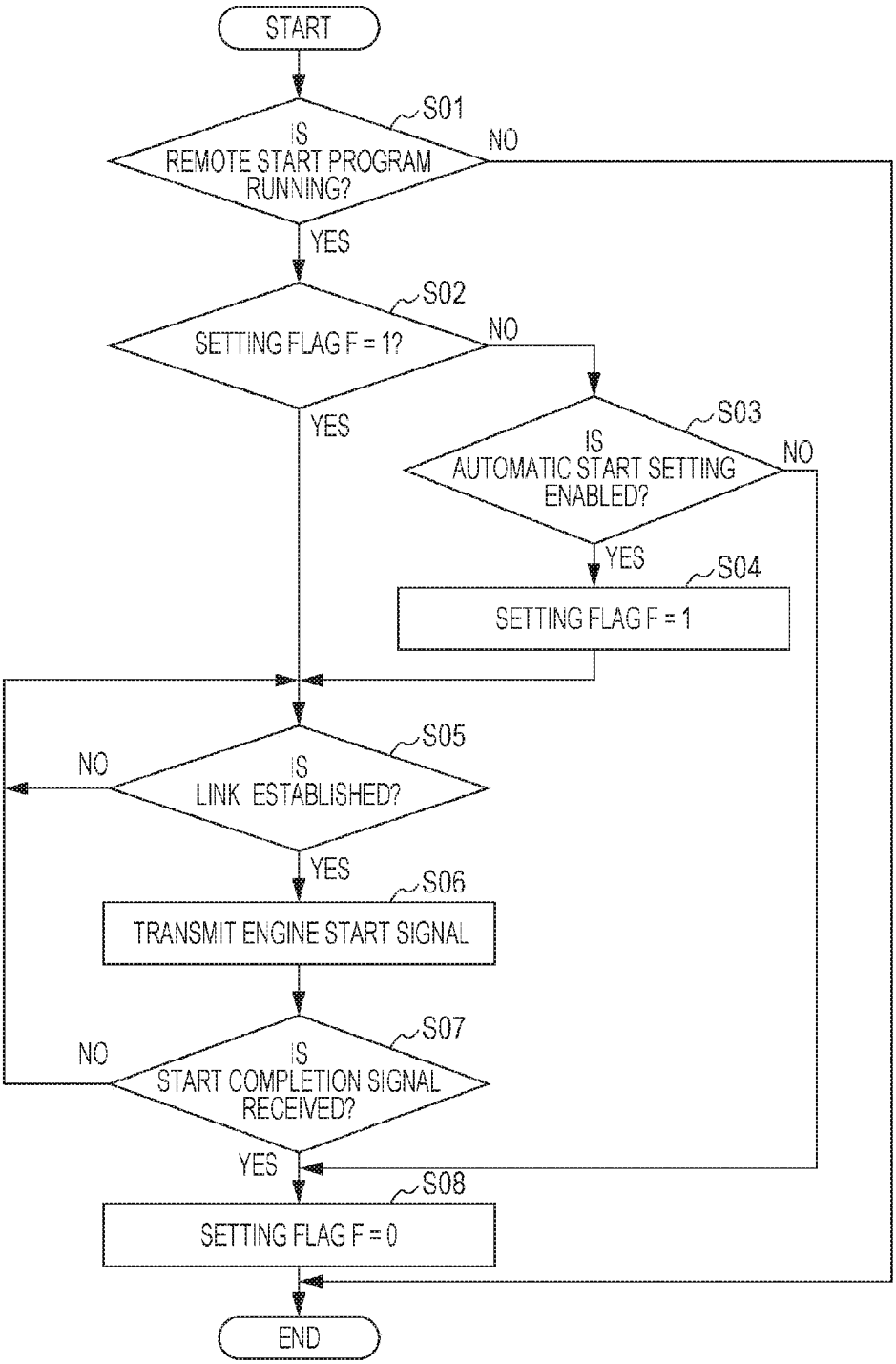
FIG. 3 is a flowchart of an exemplary operation of the remote engine starting system according to the embodiment.

The remote engine starting system 10 according to this embodiment has the above-described configuration. An example of an operation of the remote engine starting system 10 will now be described with reference to FIG. 3.

The control unit 24 of the portable terminal 11 determines whether a remote start program for remotely starting the vehicle 12 is running (step S01).

If NO in step S01, the control unit 24 terminates such a process (END).

If YES in step S01, the control unit 24 proceeds to step S02.

The control unit 24 then determines whether a setting flag F has a value of "1" indicating that enabling of the automatic start setting is selected by the user (step S02).

If NO in step S02, the control unit 24 proceeds to step S03.

If YES in step S02, the control unit 24 proceeds to step S05.

The control unit 24 determines whether the automatic start setting is enabled by the user on the setting screen displayed on the touch panel 22 (step S03).

If NO in step S03, the control unit 24 proceeds to step S08.

If YES in step S03, the control unit 24 proceeds to step S04.

The control unit 24 then sets the value of the setting flag F to "1" indicating enabling of the automatic start setting (step S04).

The control unit 24 then determines whether a wireless communication link with the vehicle 12 is established by receiving a query signal transmitted from the vehicle 12 to the predetermined wireless communication area and performing processing of link establishment including authentication (step S05).

If NO in step S05, the control unit 24 repeats the determination processing of step S05.

If YES in step S05, the control unit 24 proceeds to step S06.

The control unit 24 then determines based on the established state of the wireless communication link between the portable terminal 11 and the vehicle 12 that the portable terminal 11 is within the predetermined wireless communication area. Since the portable terminal 11 is within the predetermined wireless communication area surrounding the vehicle 12 while the automatic start setting is enabled, the control unit 24 automatically transmits an engine start signal to the vehicle 12 (step S06).

The control unit 24 then determines whether a start completion signal indicating the completion of the start of the engine 44 is received from the vehicle 12 (step S07.

If NO in step S07, the control unit 24 returns to step S05.

If YES in step S07, the control unit 24 proceeds to step S08.

Since the engine 44 is started in response to the engine start signal, the control unit 24 sets the value of the setting flag F to "0" indicating disabling of the automatic start setting (step S08). After that, the control unit 24 terminates the process (END).

As described above, the remote engine starting system 10 according to the embodiment allows the engine start signal to be automatically transmitted to the vehicle 12 as long as the user intends to remotely start the engine 44 (that is, the automatic start setting is enabled). This can improve user convenience. Although the user is not being aware whether the portable terminal 11 is within the wireless communication area of the vehicle 12, the engine 44 is automatically remotely started while the portable terminal 11 is within the wireless communication area. This can prevent a user operation necessary to start the engine 44 from being complicated.

Furthermore, since the engine start signal from the authentic portable terminal 11 performing link establishment including authentication is validated, security can be improved.

In addition, since it is determined based on the established state of a wireless communication link with the vehicle 12 that the portable terminal 11 is within the predetermined wireless communication area, it can be accurately determined that the portable terminal 11 is within the wireless communication area without using any additional special component for determining the position of the portable terminal 11.

The automatic start setting is disabled when the engine 44 is started in response to the engine start signal. If the user forgot that he or she enabled the automatic start setting at the last remote start and enters the communication area of the vehicle 12, therefore, the engine 44 can be prevented from being started regardless of user's intention.

Since the light 47 is turned on or blinked simultaneously with the start of the engine 44, it is unnecessary for the portable terminal 11 to have a function for answer-back control associated with the start of the engine 44. This can simplify predetermined programs executed by the portable terminal 11, leading to a reduction in power consumption of the portable terminal 11.

The air in the vehicle interior can foe partially discharged to the outside by opening the openable and closable structure of the openable and closable unit 46 as well as actuating the air-conditioner 45, thus allowing the temperature of the vehicle interior to approach a target temperature in a shorter time.

Since the portable terminal 11 performs display on the display screen 22*a* of the touch panel 22 and sets either enabling or disabling of the automatic start setting in accordance with the programs stored in the portable terminal 11, an automatic starting function can be easily added to the portable terminal 11 of a general purpose type.

A modification of the above-described embodiment will now be described.

In the above-described embodiment, the control unit 24 determines based on the established state of the wireless communication link with the vehicle 12 that the portable terminal 11 is within the predetermined wireless communication area surrounding the vehicle 12. Another way of determining whether the portable terminal 11 is within the predetermined wireless communication area may be used.

For example, when a detected strength of a received signal in periodic communication with the vehicle 12 at regular intervals is greater than or equal to a predetermined value, the control unit 24 may determine that the portable terminal 11 is within the predetermined wireless communication area. When the strength of the received signal is less than the predetermined value, the control unit 24 may determine that the portable terminal 11 is outside the predetermined wireless communication area. After the establishment of the wireless communication link with the vehicle 12, when the control unit 24 determines based on the strength of a received signal that the portable terminal 11 is moved out of the predetermined wireless communication area surrounding the vehicle 12, the control unit 24 may disconnect the wireless communication link from the vehicle 12.

In the foregoing embodiment, when the portable terminal 11 is moved into the predetermined wireless communication area, the control unit 24 communicates with the vehicle 12 and sets enabling or disabling of the automatic start setting in accordance with a preset user selection. Another operation may be performed.

For example, when the portable terminal 11 is moved into the predetermined wireless communication area, as long as enabling or disabling of the automatic start setting is not selected in advance by the user, the control unit 24 may allow the display screen 22*a* to display the setting screen for enabling or disabling the automatic start setting.

In the foregoing embodiment, the control unit 24 of the portable terminal 11 is a software functional component achieved by implementation of the programs, stored in the memory, through the processor, such as a CPU, in the control unit 24. Another configuration may be used.

The control unit 24 may be a hardware functional component, such as a large scale integration (LSI) or an application specific integrated circuit (ASIC).

Although the portable terminal 11 includes the touch panel 22 in the foregoing embodiment, another configuration may be used. The portable terminal 11 may include an operation switch and a display unit instead of the touch panel 22.

The foregoing description of certain embodiments of the present disclosure has been presented for purposes of illustration and description, and is not intended to limit the scope of the disclosure. These embodiments may be embodied in a variety of other forms. Various omissions, substitutions, and changes may be made without departing from the spirit of the disclosure. The accompanying claims and their equivalents are intended to cover such forms or modifications as would fall within the scope and spirit of the disclosure.

What is claimed is:

1. A remote engine starting system comprising:

a portable terminal that is carried by a user and configured to transmit an engine start signal out of the portable terminal for remote engine start; and a vehicle that has an engine and is configured to communicate with the portable terminal within a predetermined communication area defined by a predetermined range from the vehicle and is able to start the engine in response to receipt of the engine start signal transmitted from the portable terminal, the portable terminal comprising:

a determiner for a portable terminal location that determines whether the portable terminal is within the predetermined communication area, the determiner determining that the portable terminal enters the predetermined communication area when a communication between the vehicle and the portable terminal is established, a controller that communicates with the vehicle when the determiner determines that the portable terminal is within the predetermined communication area, and a setting controller operable by the user to switch settings for the remote engine start between a first setting that allow the portable terminal to transmit the engine start signal and a second setting that does not allow the portable terminal to transmit the engine start signal, wherein the controller automatically transmits the engine start signal directly to the vehicle via the established communication between the vehicle and the portable terminal when the determiner determines that the portable terminal enters the predetermined communication area and the first setting is set in the setting controller.

2. The system according to claim 1, wherein the vehicle periodically transmits a query signal out of the vehicle to the predetermined range surrounding the vehicle, which defines the predetermined communication area, when the communication between the vehicle and the portable terminal is not established, and wherein the portable terminal confirms authentication thereof with the vehicle upon receiving the query signal and performs establishment of said communication when the portable terminal receives the query signal and the authentication is confirmed.

3. The system according to claim 1, wherein the determiner determines that the portable terminal is within the predetermined communication area based on a result that the communication between the portable terminal and the vehicle is established.

4. The system according to claim 1, wherein the setting controller changes the first setting to the second setting when the engine is started in response to the engine start signal transmitted from the portable terminal.

5. The system according to claim 1, further comprising a lighting device provided to an exterior of the vehicle, wherein the vehicle allows the lighting device to turn on or blink in response to the receipt of the engine start signal.

6. The system according to claim 1, further comprising an air-conditioner for air conditioning in the vehicle, an openable and closable structure of the vehicle for air ventilation thereof, and a temperature sensor that detects a temperature inside the vehicle, wherein when the engine is started in response to the engine start signal transmitted from the portable terminal, the vehicle actuates the air-conditioner to control the temperature to be a predetermined target temperature and opens the openable and closable structure by a predetermined amount when the temperature inside the vehicle is higher than the target temperature by a predetermined value or more.

7. The system according to claim 1, wherein the portable terminal has a display screen through which the user can operate the setting controller to select either of the first setting or the second setting and stores a program therein for executing operations of the display and the setting controller.

* * * * *